US007152992B1

(12) United States Patent
Monroe et al.

(10) Patent No.: US 7,152,992 B1
(45) Date of Patent: Dec. 26, 2006

(54) LIGHT FIXTURE MOUNTING BRACKET

(75) Inventors: Tim E. Monroe, Lincoln, CA (US); John H. Wandrey, Long Beach, CA (US)

(73) Assignee: Cordelia Lighting, Inc., Rancho Dominguez, CA (US)

( * ) Notice: Subject to any disclaimer, the term of this patent is extended or adjusted under 35 U.S.C. 154(b) by 0 days.

(21) Appl. No.: 11/296,887

(22) Filed: Dec. 7, 2005

(51) Int. Cl.
*F21S 8/00* (2006.01)

(52) U.S. Cl. ..... 362/147; 362/432

(58) Field of Classification Search ..... 362/370, 362/368, 432, 147, 145, 396, 391
See application file for complete search history.

(56) References Cited

U.S. PATENT DOCUMENTS 3,903,409 A * 9/1975 Richilano ..... 362/370
4,152,757 A * 5/1979 Bilson et al. ..... 362/217
4,156,272 A 5/1979 Wandler
4,450,512 A * 5/1984 Kristofek ..... 362/276
4,793,581 A 12/1988 Bilson et al.
5,057,983 A 10/1991 Ulrich, Sr.
5,446,636 A * 8/1995 Huang ..... 362/294
6,095,665 A * 8/2000 Drake et al. ..... 362/276
6,155,701 A * 12/2000 Leen ..... 362/432
6,322,234 B1 11/2001 Drake et al.
6,877,886 B1 * 4/2005 Schuster et al. ..... 362/431

* cited by examiner

*Primary Examiner*—Renee Luebke
*Assistant Examiner*—Julie A. Shallenberger
(74) *Attorney, Agent, or Firm*—Paul Y. Feng; Fulwider Patton LLP

(57) ABSTRACT

A lighting system including a mount for one person installation to a support surface having a rigid conduit supplying electrical wires. The lighting system includes a housing containing a light source. A hollow suspension arm extends from the housing and a back plate is located on the arm opposite the housing. The suspension arm includes a removable bottom access plate with a knock-out blank to provide optional wiring access, and the back plate includes a frangible portion. An impact blow creates an opening in the frangible portion that leads into the hollow arm. Straight and curved extension sections are provided for optional attachment to the rigid conduit. The rigid conduit is inserted through the opening in the back plate and into the arm thus suspending the lighting system therefrom.

20 Claims, 12 Drawing Sheets

LIGHT FIXTURE MOUNTING BRACKET

FIELD OF THE INVENTION

The present invention relates generally to outdoor lighting systems, and in particular, to improved structural aspects of such lighting systems for mounting the lighting system to a structural support such as a wall or post.

BACKGROUND OF THE INVENTION

It is common to erect exterior lighting around domestic, industrial, public, and military property to provide security against intruders, and to provide lighting for visitors and authorized personnel. Such a lighting system usually has a metal housing containing high voltage electrical hardware such as a transformer, a starter, etc., and includes a large, thick glass lens, all of which add to its significant collective weight. For greatest area illumination, the lighting system also tends to be very large in size. These factors present the electrician or installer with the awkward tasks of mounting the lighting system to a support structure and of connecting the electrical wiring of the lighting system to the power supply. These tasks may be made all the more awkward because they are typically accomplished at the top of a ladder. The tasks may require one electrician to hold the lighting system while another connects the wires before the system is mounted to the support structure.

One conventional solution to this common problem is to use a swinging-door type mount, which has a hinged side that is initially attached to the supporting structure with the door swung open. The heavy lighting system is then hung on the mount, and this frees the installer's hands. After the electrical wiring of the lighting system is connected, the lighting system including the mount are swung closed against the support structure and screwed in place. An example of such a mounting system is disclosed in U.S. Pat. Nos. 6,095,665 and 6,322,234 (Drake, et al.). It will be appreciated that attaching the lighting system to the support structure in this way allows the installation to be carried out in two stages by one person.

However, the Drake mount has numerous disadvantages. First, the mount must be constructed in at least two hinged pieces to create the swinging door effect, which increases cost and complexities during fabrication. Second, once the mount is installed, the possibility exists that a heavier lighting system might accidentally detach and swing open from its suspended position. This exposes the lighting system to malfunction or even tampering by unauthorized persons.

Third, the mount is designed for connection to only one type of wiring configuration found on the support surface, typically an electrical junction box recessed into a wall of a house or building. Unfortunately, it is possible for the electrician to encounter a number of different wiring configurations and receptacles that may not be easily connected to such a mount. For example, where the power supply wires are fed through a rigid conduit extending from the outside or the interior of the wall, or where the power supply wires protrude from the supporting surface without a J-box, connection to such varied situations may be problematic. The Drake mount is thus not easily adaptable in the field.

Hence, there is a need for a lighting system with a mount that is easy to attach to the support structure by a single person, that can be adapted for connection to different wiring configurations, and that cannot easily be detached from the support structure. The present invention addresses these and other needs.

SUMMARY OF THE INVENTION

The present invention is directed to providing a lighting system that is easy for a single individual to install on a support structure without assistance, and that cannot be easily detached from the support structure. One embodiment of the invention provides that, even if the electrician encounters a variety of different wiring configurations on the support structure, the novel aspects of the invention nevertheless allow the electrician, alone and unassisted, to attach the lighting system to the support structure, even from the top of a ladder. The lighting system mount is thus versatile and highly adaptable in the field.

Three different preferred embodiment wiring and structural configurations on a support structure are described below, which enable easy installation by a single electrician. By eliminating the need for a second electrician, the labor costs involved in installing the present invention lighting system is reduced by 50 percent.

In one embodiment, the lighting system comprises a housing containing a light source connected to a power supply. To facilitate connection of the lighting system to a typical, vertically oriented support surface such as a wall of a building, a horizontal arm extends from the housing and terminates with a back plate for easy fitment to that wall. The arm is hollow and is enclosed by a removable access plate held in place preferably with screws. The back plate is configured for easy connection to the support surface, and, in a preferred embodiment, the back plate includes a frangible portion that breaks away from the back plate upon application of a sufficiently hard blow so as to produce an opening in the plate.

In another aspect of the invention, the frangible portion is circular, and is adapted to be compatible with a number of possible wiring situations. First, the opening created by the frangible portion may admit the electrical wiring from the support structure directly into the hollow arm, while the back plate is connected to the support structure. After the back plate is thus connected, the wiring from the support structure may be connected to the wiring of the lighting system. Second, the opening created by the frangible portion may admit a cylindrical conduit containing electrical wiring so that the conduit may support the weight of the lighting system before the electrician connects the wiring in the conduit to the wiring in the lighting system.

It will be appreciated that both of these situations are compatible with an individual electrician attaching the lighting system to a support system without assistance. Finally, if the electrician should encounter neither of these wiring configurations, but instead encounters the supply wiring attached to the exterior surface of the support surface in a flexible conduit, he may elect not to break out the frangible portion, but leave it in place to provide a complete seal against water, rain, snow or weather-related ingress. Instead, the electrician may manually press out a knock-out blank in the access plate, and may connect the flexible conduit to the access plate, passing the supply wiring through the resulting opening.

Other features and advantages of the present invention will become apparent from the following detailed description, taken in conjunction with the accompanying drawings, which illustrate, by way of example, features of the invention.

DETAILED DESCRIPTION OF THE PREFERRED EMBODIMENTS

Figure 1:
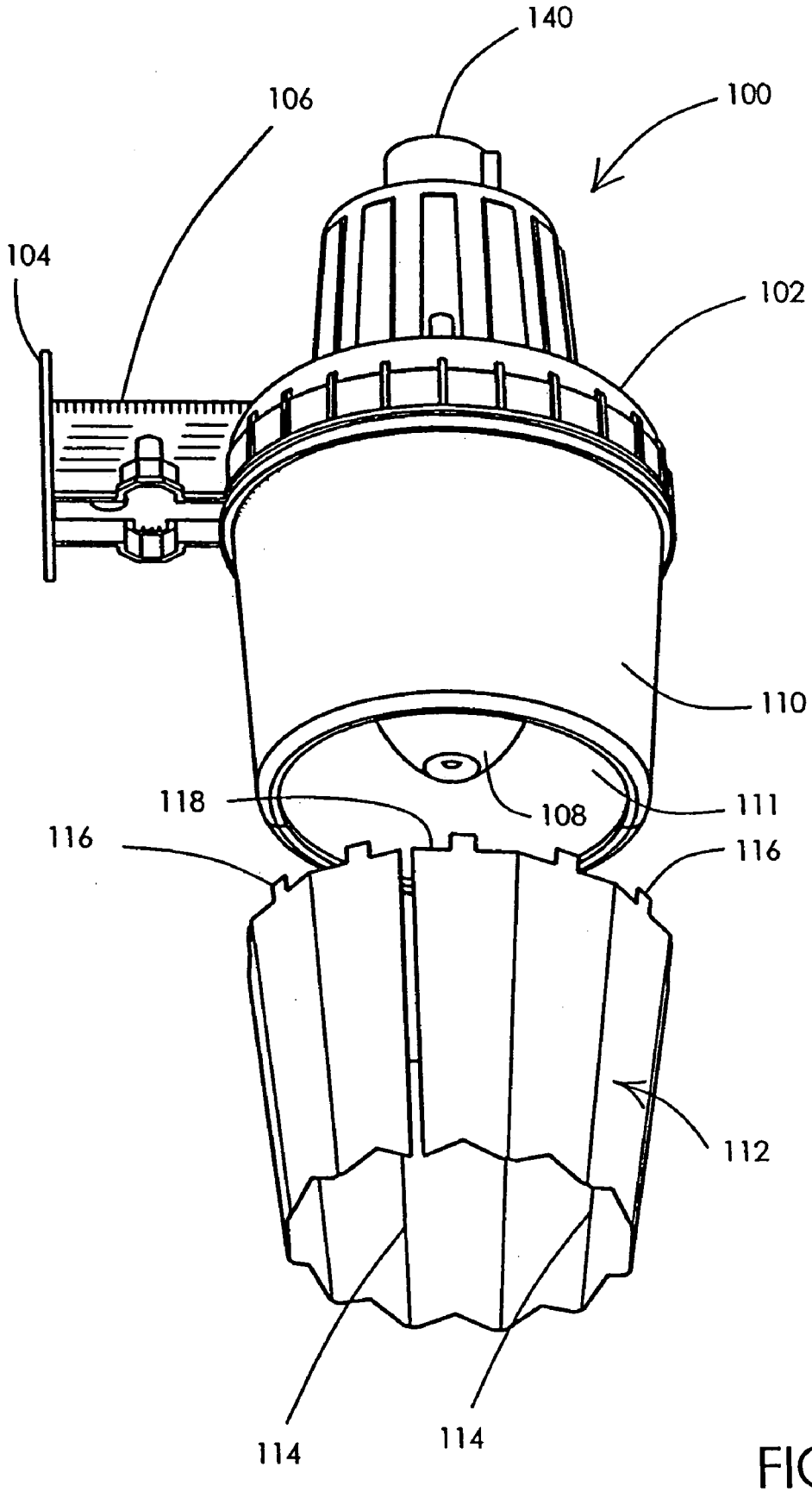
FIG. 1 is a perspective view of a lighting system showing aspects of the present invention.

As shown in the drawing figures, which are provided for purposes of exemplary illustration, the present invention is directed to a lighting system 100. The lighting system 100 employs mounting hardware that necessitates only one electrician or technician for installation, and further benefits from mounting hardware that is easily customized and adapted in the field.

Figure 2:
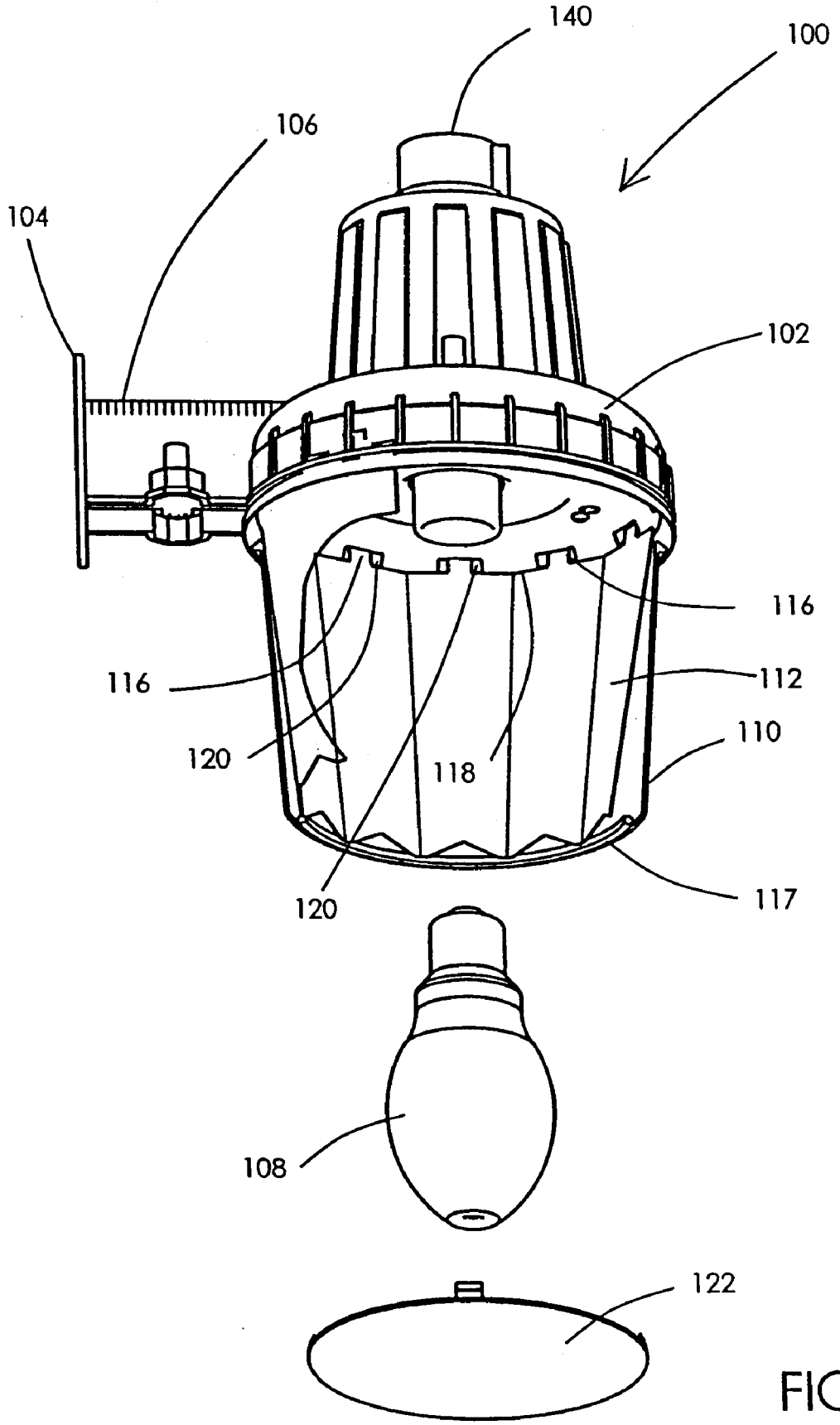
FIG. 2 is partial cutaway perspective view of the lighting system of FIG. 1.

Referring to FIGS. 1–2, forming the central portion of the lighting system is a housing 102 preferably made of a metal such cast iron, steel, aluminum, bronze, plastic or the like. A hollow suspension arm 106 extends from the housing 102 and terminates with a vertical back plate 104. Preferably, these structures may be molded, cast, stamped, or machined as an integral, single piece, or they be assembled and then welded, soldered, cemented, screwed, snapped, or joined together from several pieces. The back plate 104 is configured to mount the housing 102 to a wall, post, or like permanent or semi-permanent support structure. The housing 102 is designed to contain a light source 108, such as an incandescent bulb, LED cluster, neon tube, halogen bulb, mercury-vapor element, or the like, which is connected to an electrical power supply in the conventional way. The exterior of the housing 102, back plate 104, and suspension arm 104 may be coated, painted, or surface treated for weather resistance.

At the bottom of the housing 102 is a generally cylindrically shaped lens 110 for optimal light diffusion, and may be made of molded plastic, glass, or other suitable translucent or transparent material. The lens 110 may have an open bottom as shown in FIG. 1, or the lens 110 may be formed with a closed bottom, or have a covered bottom by addition of a removable cover 122. The lens 110 defines an internal chamber 111 that surrounds the light source 108.

A light shield 112 may be inserted within the chamber 111 of the cylindrical lens 110 in order to strategically limit, block, or diminish the amount and direction of light emitting through the lens 110. Preferably, the light shield 112 is fabricated from a thin, initially planar sheet of metal, bent or folded along fold lines 114 at regular intervals to produce a generally cylindrical shape that is conveniently shaped and inserted into the chamber 111.

In various embodiments, the light shield 112 may be fabricated from stamped aluminum, galvanized iron, foil covered cardboard or foam, heat resistant plastic, fiberglass, or the like. Ideally, the light shield 112 is completely opaque or translucent with a very low amount of transmissivity to greatly limit visible light transmission. An optionally polished or reflective interior surface of the light shield 112 improves light or lumens output through and around an open bottom lens 110.

The light shield 112 may have a corrugated appearance with discrete fold lines 114 as shown in FIGS. 1–2, or it may be a smooth walled cylinder with perforations or cut lines replacing the fold lines 114. The light shield 112 may further have a vertical seam as seen in FIG. 1 or may be a round- or polygonal-shape seamless tube.

In one preferred embodiment, the shield 112 is configured so that its shape may be modified by the electrician or technician carrying out the installation. The modification is accomplished by selectively cutting away portions of the shield 112 to provide a window of desired size and shape that may be oriented within the refractor lens to permit light to be cast out in that desired direction and intensity. To ease the formation of the window for passage of light, the fold lines 114 may be intentionally weakened areas that cut easily or may be hand separated without using a blade or scissors. Thus, large rectangular sections of the light shield 112 may be removed with ease. Those rectangular sections removed may be contiguous or may be discrete panels.

In an alternative embodiment, the fold lines 114 may correspond with perforations again permitting easy removal of sections of the light shield 112. Preferably, the fold lines, pre-cut or pre-scored lines, perforations 114 run vertically along the height of the shield 112, as seen in FIGS. 1–2. In various alternative embodiment (not shown), the cut lines may extend circumferentially, or may have rectangular or triangular shapes to form correspondingly shaped windows in the shield 112. Also, the pre-sore or precut lines, perforations, or fold lines may be omitted altogether; if the light shield is made from a material such as polyurethane or nylon that is sufficiently thin yet optically opaque enough to block visible light, then the electrician or homeowner may simply cut out the window or windows with household scissors.

Accordingly, the shield 112 may be easily and quickly cut or shaped by hand to form one or more windows that enable the desired amount of light to pass through. The desired direction or directions of light passage through the window or windows are determined by the rotational orientation of the shield 112 when it is installed inside the lens 110. Indeed, it is contemplated that only one or two panels of the shield 112 be used with the remaining panels removed if the user decides that emanating light need only be blocked in a narrow band, perhaps because of leakage into a nearby neighbor's window.

To prevent the shield 112 from rotating once it is mounted within the chamber 111, one or more teeth or serrations 116 are provided along the top edge 118 of the shield, and adapted to mate with respective recesses 120 in the housing 102 (FIG. 2). The engagement between the teeth 116 of the shield and recesses 120 in the housing has the advantage of preventing the shield from rotating after being inserted within the chamber 111. This feature prevents the direction of the emanating light from being accidentally changed after installation.

To optionally hold the shield 112 within the lens 110, a lip 117 is formed at the bottom edge of the lens 110. To prevent the ingress of dust, insects, snow, rainwater, etc., a snap-on cover 122 may be installed at the bottom end of the lens 110. The cover 112 is preferably made of refractive translucent material the same as the refractor lens 110, but may be opaque, or selectively opaque as desired.

Figure 3:
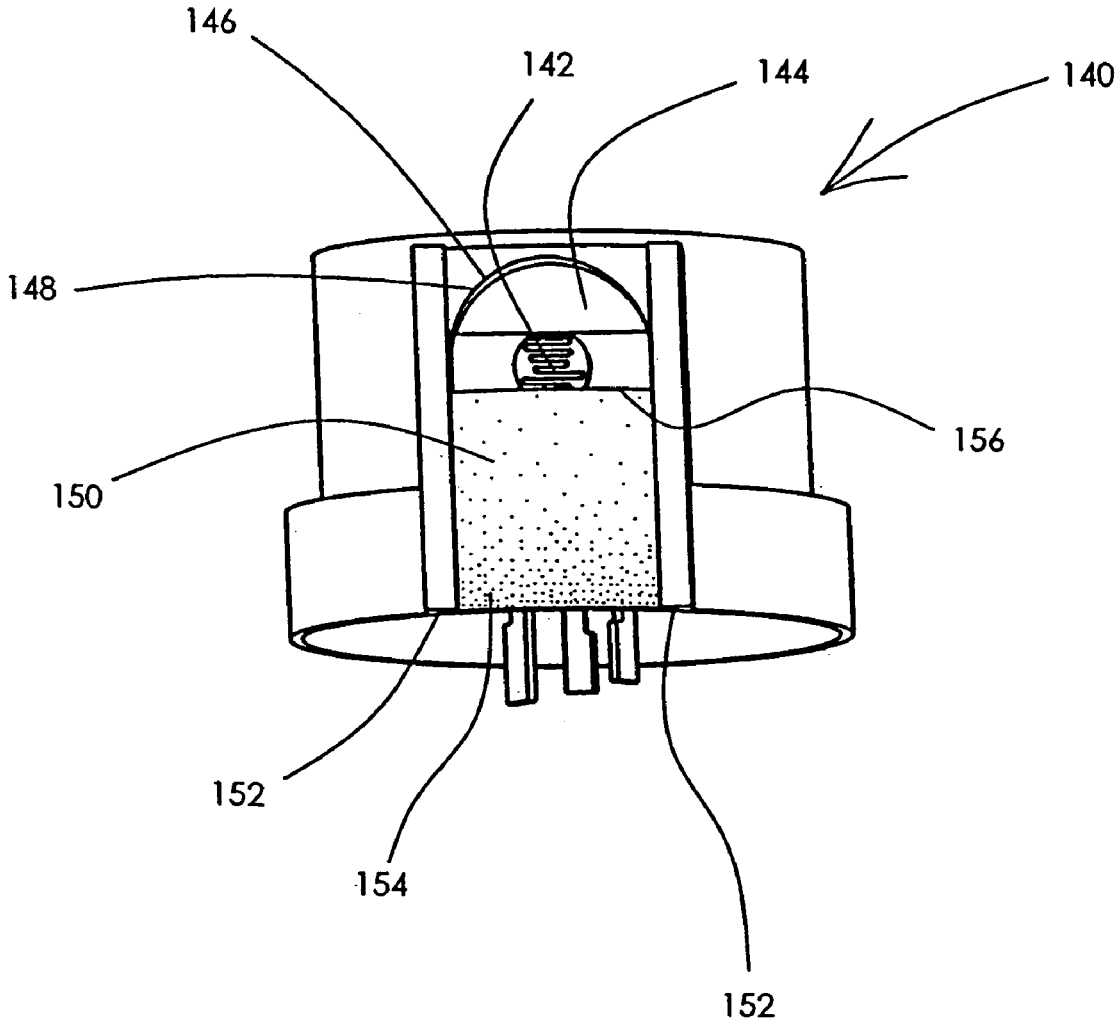
FIG. 3 is a detail view of a photocell used in conjunction with one embodiment of the present invention.

FIG. 3 shows in greater detail an optional photocell 140 mounted on top of the housing 102. Based on ambient lighting conditions, the photocell 140 triggers a switch that controls electrical power for the light source 108. When the level of ambient light falls below a certain level, the photocell 140 switches on the power supply, and when the level of ambient light rises above a certain level, the photocell 140 switches off the power supply to conserve electricity.

The photocell 140 includes a light sensor 142 known in the art, positioned to receive ambient light incident upon the sensor. The sensor 142 may be sheltered within a shallow chamber 144 in the photocell, the chamber defining an opening 146 to admit ambient light. A fixed translucent screen 148 is placed across the opening to protect the sensor 142 from dust, insects, snow, or debris that may settle on the photocell over time. Preferably, the fixed screen 148 is adapted to be cleaned periodically. Additionally, a movable screen 150 may be provided in front of the fixed screen 148 to adjustably shut off ambient light, in part or fully, entering the opening 146, and to thus adjustably obstruct the incidence of ambient light upon the sensor 142. The movable screen 150 may be movably secured to the photocell by providing a pair of slots 152 around the opening, the slots being adapted to hold the edges of the movable screen 150 while at the same time permitting the movable screen to slide vertically up and down to expose or to obstruct the opening.

While in one embodiment the movable screen 150 may be entirely opaque, in a second, preferred embodiment, the movable screen may be opaque at a first end 154, and translucent at a second end 156. Opacity at the first end may be provided by paint applied to the screen which may be made of a translucent material such as plastic. In between the first and the second ends, opacity may gradually fade to translucency. This fading effect may be achieved by applying an ever decreasing thickness of paint on the screen's underlying translucent material toward the second end 156, or, alternatively, by spraying a series of dots of constant thickness on the underlying material, but arranging the dots to have ever decreasing diameters toward the second end, or further alternatively, with ever increasing spacing between the dots toward the second end. The result may resemble shading from dark at the first end to light at the second end such as is known and used in the printing industry.

It will be appreciated that the amount of ambient light entering the chamber to fall upon the sensor 142 may be adjusted by adjusting the vertical position of the movable screen 150 in the slots 152. For example, if the average level of ambient light found in a particular environment is intense, it may be found that the photocell triggers the off switch too late in the evening and too early in the morning. To compensate for such high average levels of ambient light, the position of the movable screen may be set to reduce the amount of light entering the chamber, thereby causing the sensor to trigger the off switch earlier in the evening, and later in the morning. The converse will apply if the average level of ambient light is low. It will be further appreciated that providing the movable screen with graduated shading, as described herein, provides the screen with greater potential sensitivity for adjusting the amount of ambient light that is admitted. For example, without graduated shading, an entirely opaque screen may shut out, say, 10% of the ambient light entering the chamber by moving the screen to shut the opening by only 1 mm. On the other hand, an equivalent screen with graduated shading may shut out 10% of the ambient light entering the chamber by moving it 5 mm. This will allow the user to set the screen to exclude smaller graduated percentages of light, such as 2%, 4%, 6%, etc. by moving it 1 mm for each graduation. It will be appreciated that this aspect will assist the user to adjust the timing of the photocell off and on switch by smaller time intervals.

In another exemplary embodiment of the present invention, FIGS. 4–9 depict a novel mounting system 200 for connecting the lighting system 100 to a wall, roof, post, pilaster, column, or other support structure. The mounting system 200 enables a fairly heavy and/or bulky, indoor or outdoor light fixture to be installed to a building, lamp post, or the like by one person, which job would otherwise require two people for a conventional mounting system. There is clearly a cost savings in the skilled labor needed. Furthermore, the mounting system 200 is easily customizable to quickly adapt the mounting hardware to the specific installation application in the field.

Figure 4:
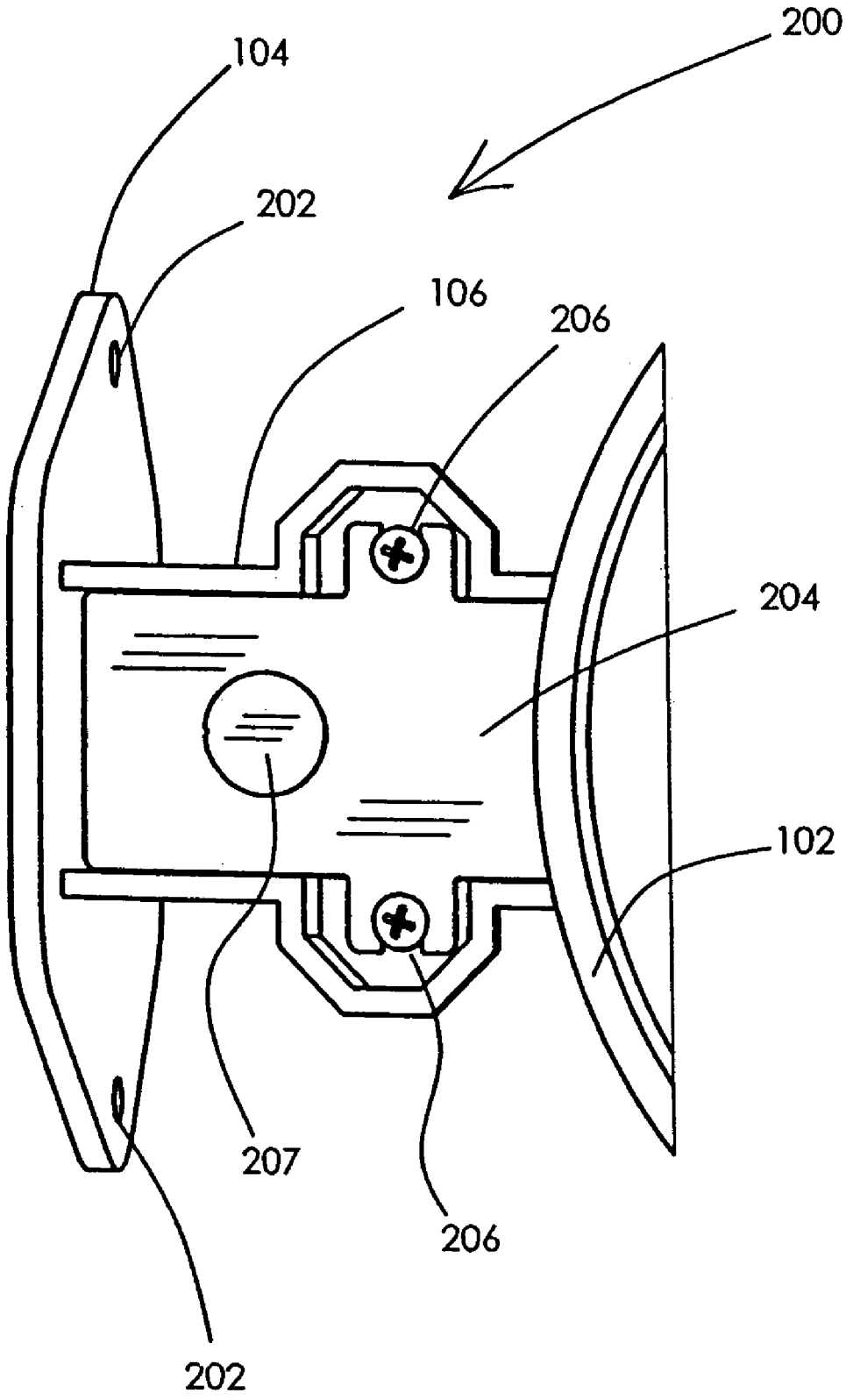
FIG. 4 is a bottom view of a hollow suspension arm enclosed by a removable access plate having a knock-out blank formed therein.

In a preferred embodiment, the mounting system 200 as seen in FIG. 4 includes a generally vertical back plate 104 having a plurality of holes 202 to allow for bolting the plate 104 to a wall, lamp post, building, or like support structure. Typically, the mounting system 200 is disposed at the rear of the light fixture as seen in FIG. 4. A hollow suspension arm 106 connects the back plate 104 to the housing 102.

Preferably, the hollow suspension arm 106 is enclosed at the bottom by a discrete, removable access plate 204 that may be held in place by one or more screws 206. The removable access plate 204, being preferably located at the bottom face of the arm 106, is shielded by the arm from weather effects such as rain or snow.

A knock-out or pop-out blank 207 is provided in the plate 204, which is conveniently detached in the field via pressing on the knock-out blank 207 by hand. To facilitate the pop-out action, the blank 207 may already be partially detached from the access plate 204 except for one or more support tabs, or the blank 207 may be pre-scored, pre-cut, or be deeply notched around its circumference, or any combination thereof. Preferably, the access plate 204 is made from galvanized sheet steel and the knock-out blank 207 is a partially punched out shape. The weakened, thin wall or pre-cut circumference around the blank 207 permits easy separation from the access plate 204 by thumb pressure or by a light hammer blow.

Figure 5:
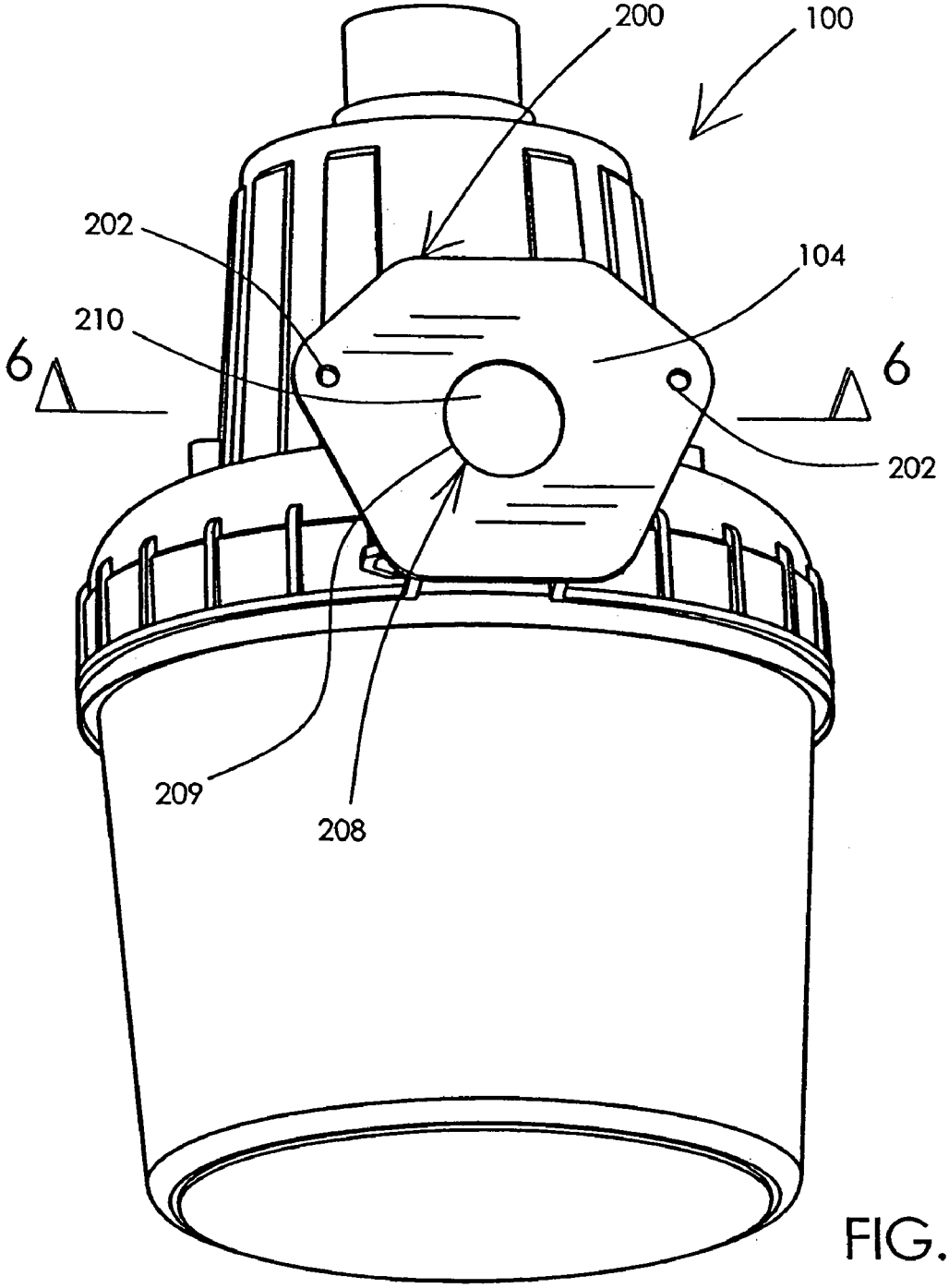
FIG. 5 is a rear elevational view of the lighting system showing a back attachment plate used in the present invention in a closed condition.
Figure 6:
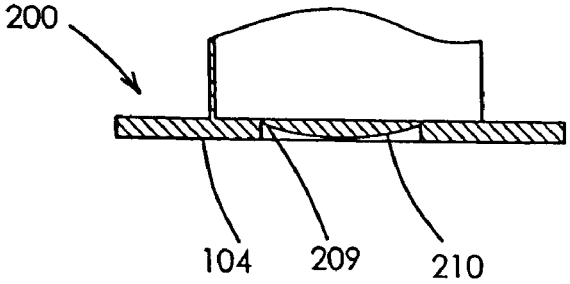
FIG. 6 is a cross-sectional view taken along line 6—6 in FIG. 5 depicting the frangible portion.
Figure 7:
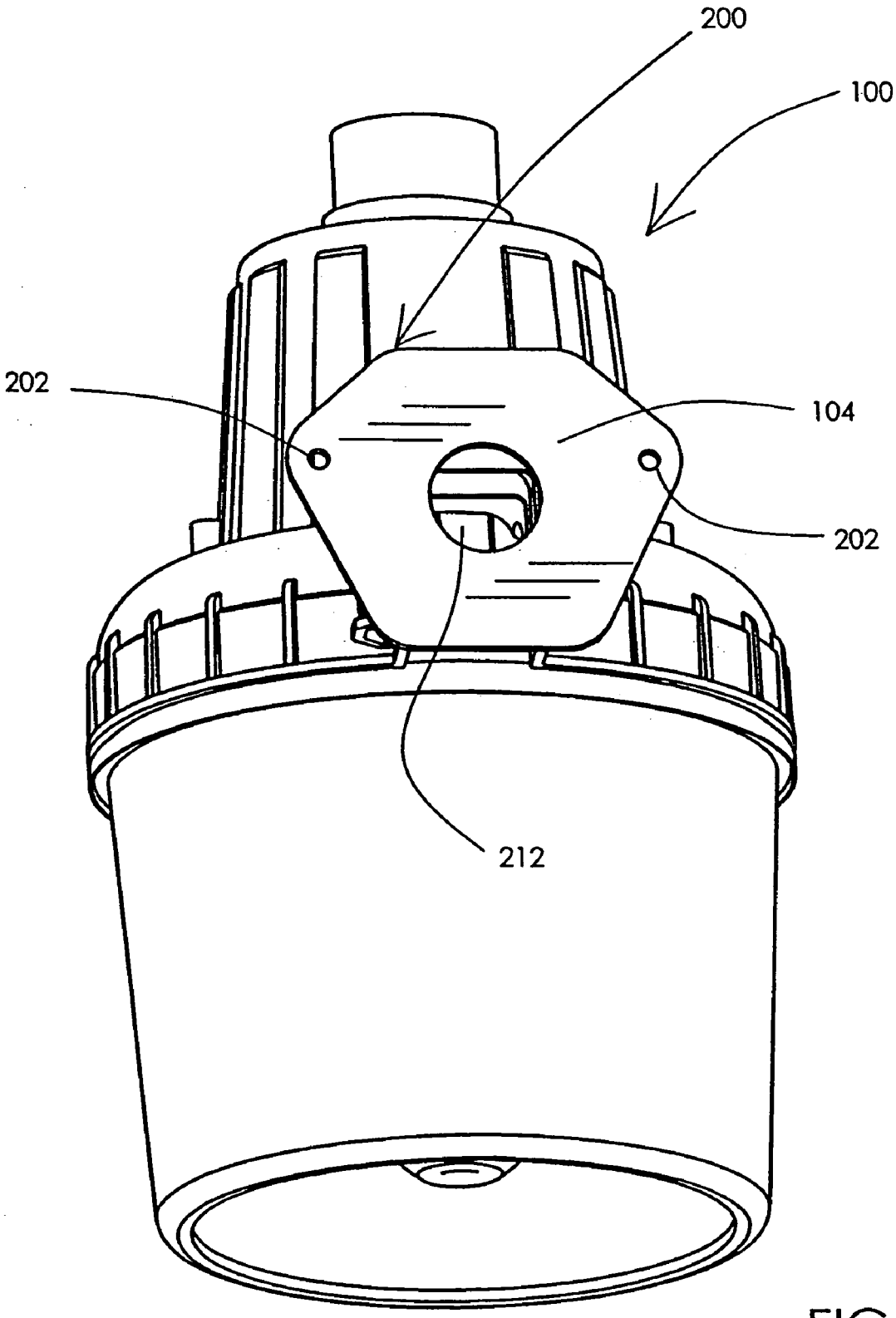
FIG. 7 is a rear view of the lighting system showing the back plate of FIG. 5 in an opened condition with the frangible portion removed.

In a preferred embodiment, the back plate 104 also includes a pre-formed knock-out blank 208 as seen in FIGS. 5–7. Unlike the knock-out blank 207 in the access plate 204, the pre-formed knock-out blank 208 in the back plate 104 optionally provides a completely water tight seal before a frangible portion thereof is removed. The back plate 104 is preferably made from the same material as the arm 106 and housing 102. Thus, the back plate 104 is usually made of metal and is shaped, optimally, by cutting on a lathe, by casting to the desired shape, or by stamping or punching operations.

During fabrication, the back plate 104 is made with a weakened circumference 209 around an inner eye or frangible portion 210. This weakened area requires only a light to moderate impact blow to the eye 210 to break the weakened circumference 209 so as to permit the eye 210 to fall out, thereby leaving an opening 212 (FIG. 7) in the plate 104 through which access may be gained to the interior of the suspension arm 106. The weakened circumference 209, as seen in the cross-sectional view of FIG. 6, has very little wall thickness enabling detachment versus a thick central portion that receives the brunt of the impact blow. The weakened circumference 209 may further include or be replaced by a deep notch, cut, or pre-scoring, or any combination thereof.

Or the eye 210 may be completely detached except for one or several supporting tabs connecting it to the back plate 104. If mostly detached, a rubber, cement, or tape O-ring circumscribing the eye 210 can seal out the environment. Paint can also be used to seal the gap around the eye 210.

Figure 8:
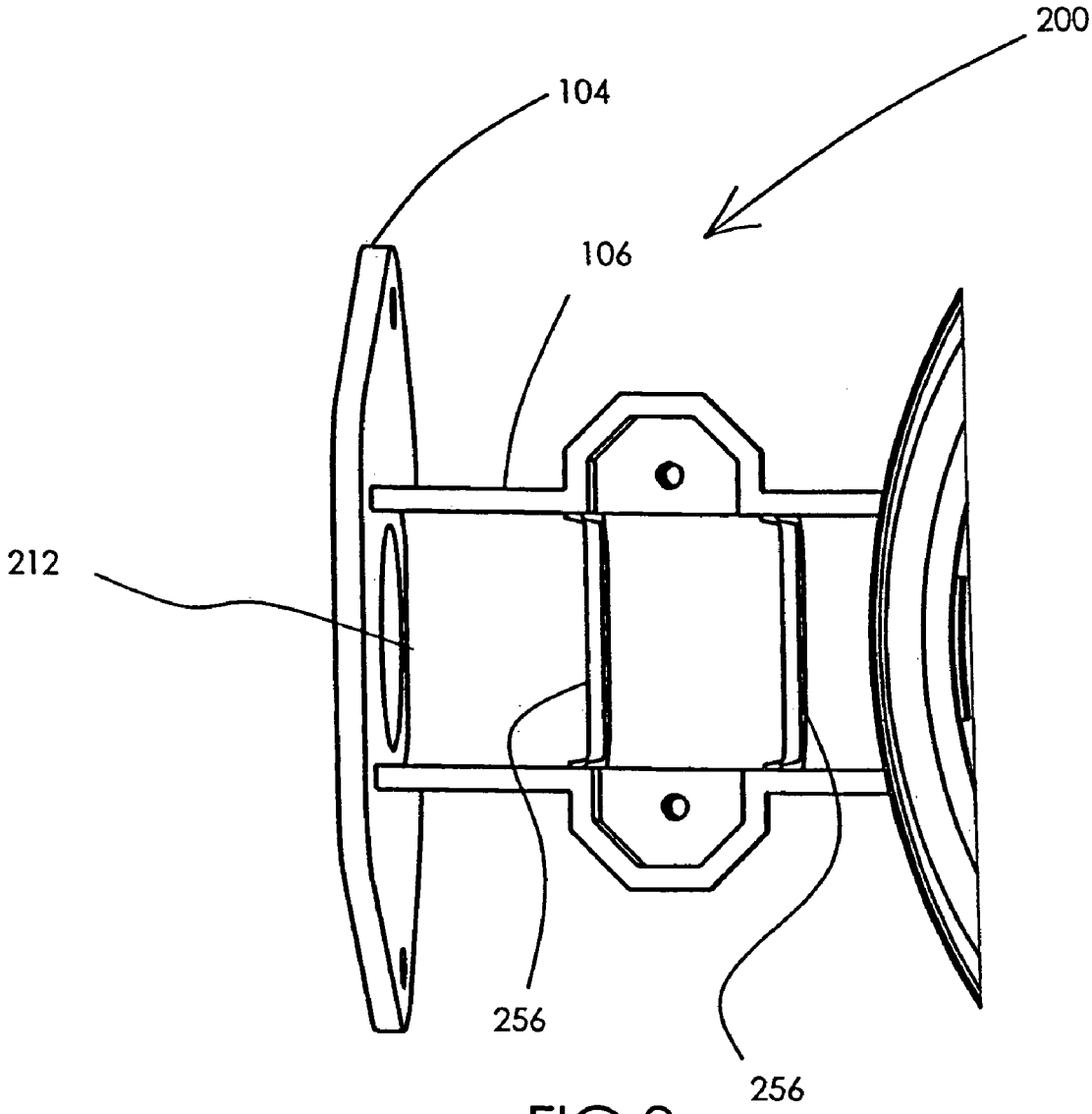
FIG. 8 is a bottom view of the hollow suspension arm of FIG. 4 with the access plate removed to expose the interior.
Figure 9:
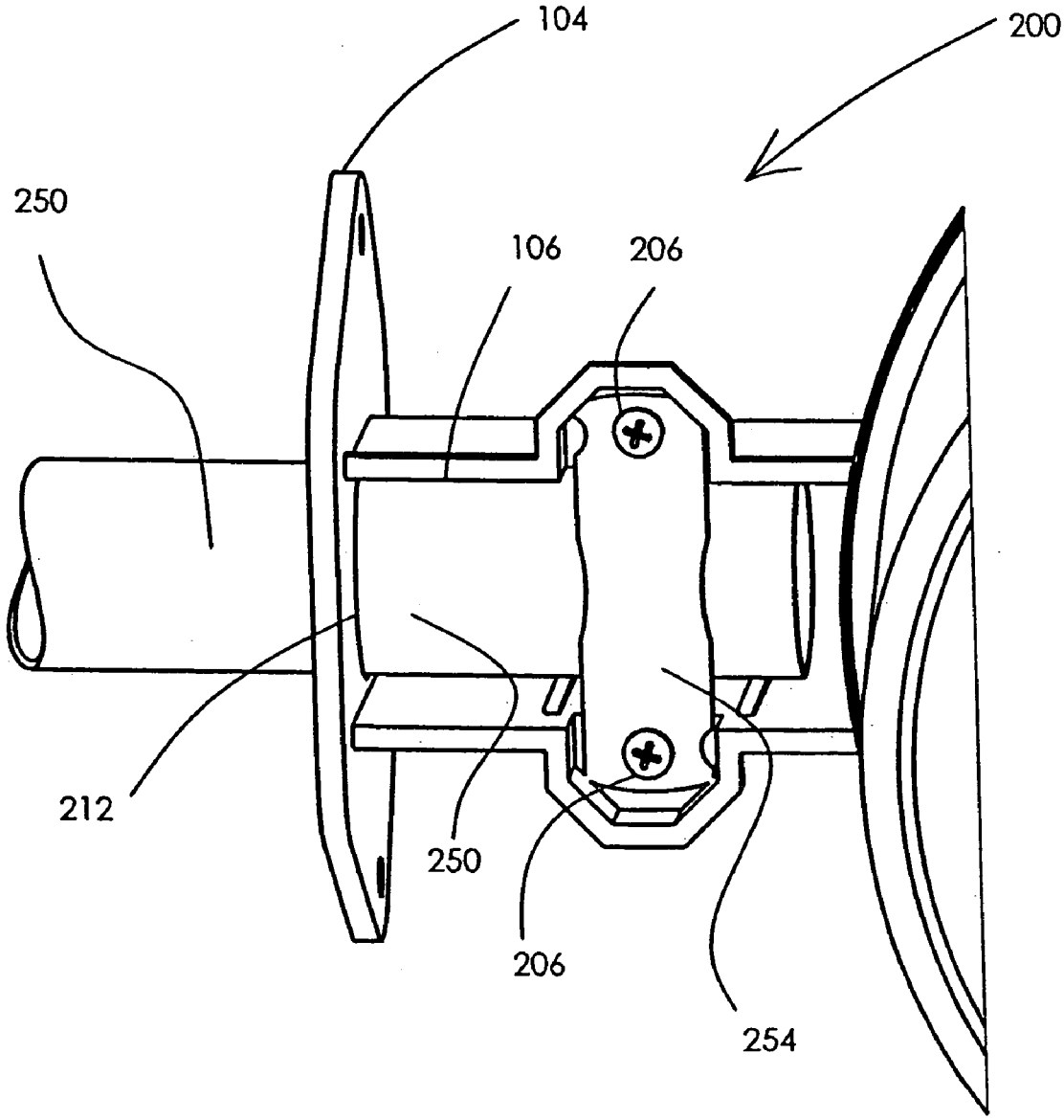
FIG. 9 is a bottom view of the suspension arm of FIG. 4 mounted on a conduit extending from a support structure.

In another embodiment of the present invention, exemplified in FIGS. 8–9, the mounting system 200 may be configured so that a generally horizontally-oriented, rigid pipe or conduit 250 (FIG. 9) may be inserted through the opening 212 and lodged deep enough within the suspension arm 106 to support the entire weight of the lighting system. The conduit 250, usually a rigid metal pipe, is part of a lamp post or support hardware attached to a building or like support structure, and typically carries within it the power supply wiring from the building to the lighting system. The mounting system 200 therefore utilizes the rigid conduit 250 for both lamp support and to bring in electrical power. No other mounting bolts or hardware is needed to support the weight of the lighting system.

To facilitate secure engagement of the rigid conduit 250 within the suspension arm 106, an optional clamping system may be provided. Specifically, a clamping plate 254 (FIG. 9) is mounted to the suspension arm 106 and firmly holds the horizontal conduit 250 therein. To further bolster positive engagement with the conduit 250 and to strengthen the suspension arm 106, one or more plate-like ribs 256 (FIG. 8) may be formed in the opposing interior wall of the suspension arm, transverse to the longitudinal axis of the arm. Preferably, the clamping plate 254 is screwed into or bolted to the arm 106 so it applies force against the conduit 250. Advantageous, the same screws 206 used to secure the access plate 204 to the arm 106 can be used to secure the clamping plate 254, thus simplifying construction and minimizing the number of steps required to install the lighting system. Indeed, this mounting/clamping step can be performed in one action by advancing the screws with the access plate and clamping plate in place.

The above described structural configuration of the mounting system 200 has the further advantage of permitting a single electrician or technician to install the lighting system 100 on a support structure, lamp post, or building on his or her own, without assistance from another individual. The mounting system 200 may also be adapted to any one of the at least three ways of installation, depending on the wiring and structural configuration encountered on the support structure to which the lighting system is to be attached.

Figure 10A:
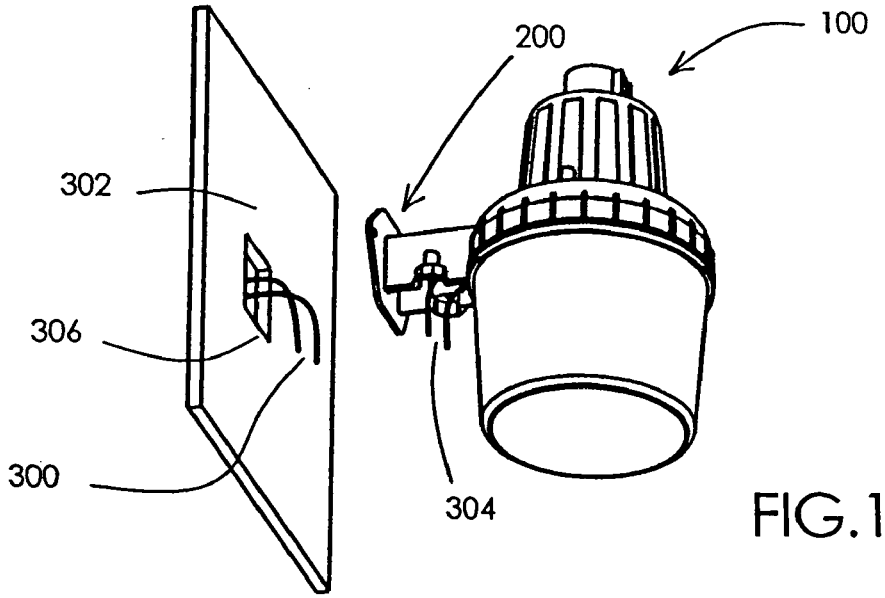
FIGS. 10A–C show steps preferably undertaken to attach the lighting system of FIG. 1 to a support structure.
Figure 10B:
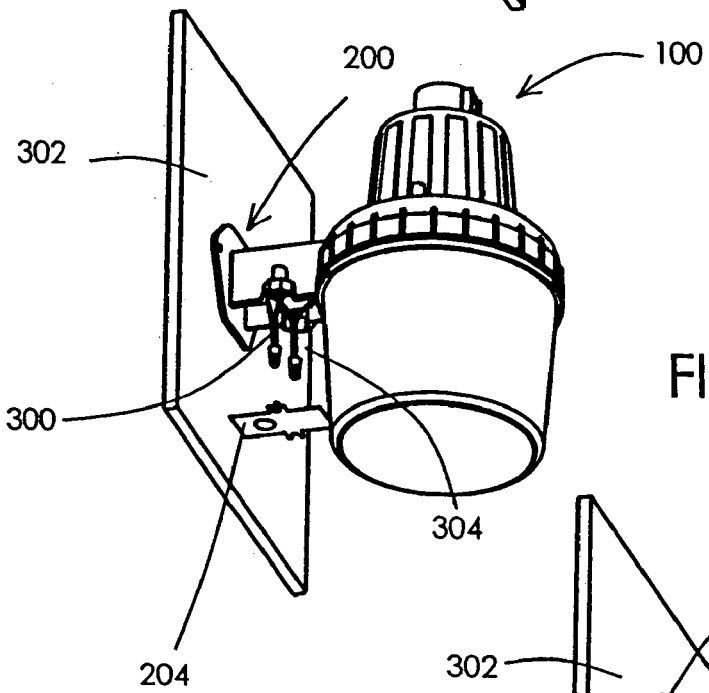
Figure 10C:
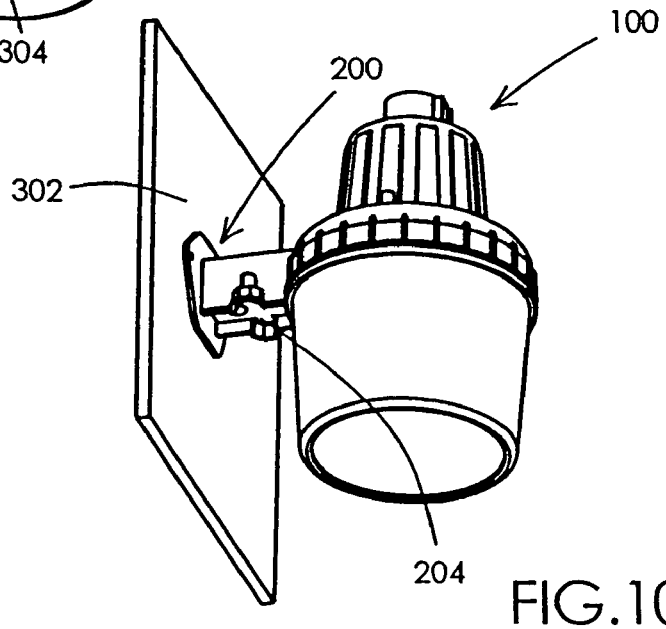

First, if, as exemplified in FIGS. 10A–C the electrician finds that the support structure has electric wires 300 protruding directly from the support structure 302 at the correct height, the following steps may be performed. The frangible portion of the knock-out blank 208 in the back plate is broken out by a hammer blow to the eye 210, thus creating an opening 212 in the back plate 104. The access plate 204 is removed to expose the hollow interior of the suspension arm 106. The electric wires 300 protruding from the support structure are pushed through the opening 212 and their ends pulled down below the suspension arm 106. The back plate 104 is bolted to the support structure with one hand while the other hand supports the lamp housing. The power supply wires 300 from the support structure are connected with the corresponding wires 304 extending into the hollow arm 106 from the housing (FIG. 10B). The wires 304 are then pushed up into the hollow arm 106, and the access plate 204 is reinstalled, leaving the lighting system securely attached to the vertical structure (FIG. 10C). Weather and other environmental effects are thus sealed out and kept away from the wiring.

Optimally, the spacing of the holes 202 on the back plate 104 is sufficient to straddle a standard 3-inch or 4-inch electrical junction box so that the supply wires may extend directly from the junction box into the opening 212 from behind the plate. It will be appreciated that the structure of the present invention allows this method of attachment to be performed by only one person, and requires that the lighting system consist of only one unit. No preliminary attachment need be made to the wall in order for the remainder of the lighting system to be hooked onto the preliminary attachment, as is the case with some prior art lighting systems. Thus, the present system has the advantage of being a unitary system which has clear advantages for manufacture, packaging, shipping, and installation.

Figure 11A:
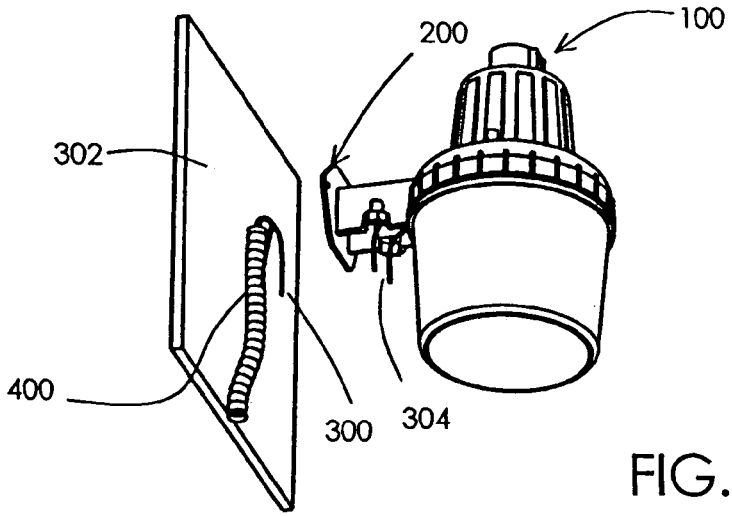
FIGS. 11A–C show alternative steps undertaken to attach the lighting system of FIG. 1 to a support structure.
Figure 11B:
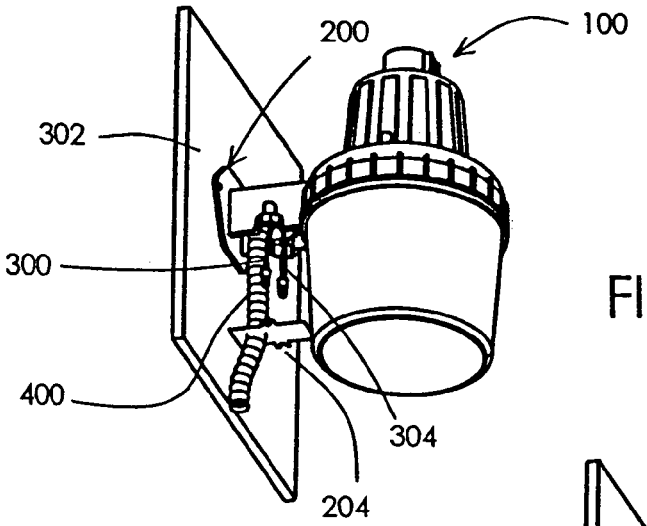
Figure 11C:
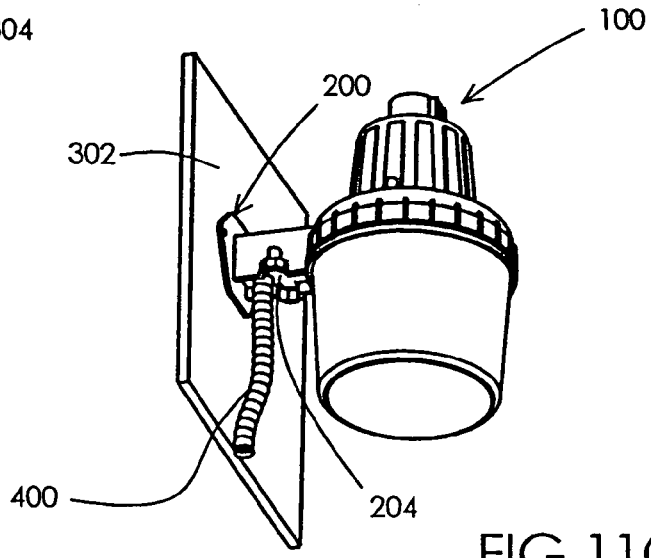

Second, if, as exemplified in FIGS. 11A–C, the electrician finds power supply wires 300 that are contained within a hose or like flexible conduit 400 running alongside the outside of the wall of the permanent support structure 302, the following steps may be performed. The lighting system 100 is first attached or bolted to the support structure 302 thus completely freeing the electrician's hands. The access plate 204 underneath the suspension arm 106 is then removed, and the knock-out blank 207 is detached from the access plate 204. The wires and/or the electrical conduit 400 is passed through the resulting opening in the access plate 204, and the individual wires are connected to the corresponding electric wires 304 extending from the lighting system housing into the hollow suspension arm 106 (FIG. 11B). The electrical conduit 400 itself may be attached to the access plate 204 using an optional connector or clamp. The access plate 204 is reinstalled, and the lighting system 100 is ready for use (FIG. 11C).

It will be understood that the sequence of these steps may be modified in any order or omitted to suit the installer, but that the structure of the invention permits the installer to erect the lighting system on his or her own. It will be further appreciated that the structure of the invention, having allowed this method of connection, permits the knock-out blank to remain unbroken in the back plate 104. This form of knock-out blank 208 has the advantage of preventing the unintended ingress of industrial or cleaning liquids, paint, insects, rodents, rain, snow, etc. into the hollow suspension arm 106 from the vertical face of the support structure during field use. With such damaging field conditions sealed out and protecting the electrical wiring therein, the lighting system 100 will function reliably for many years.

Figure 12A:
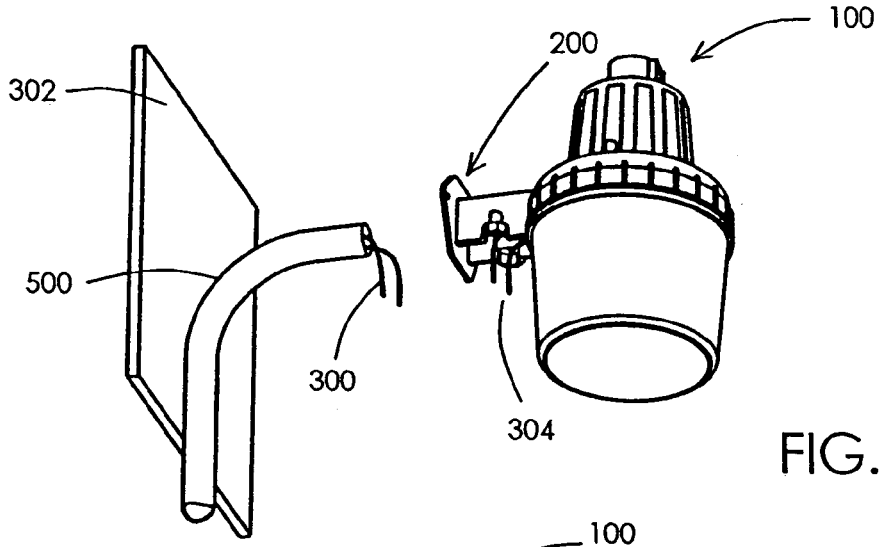
FIGS. 12A–C show further alternative steps undertaken to attach the lighting system of FIG. 1 to support structure.
Figure 12B:
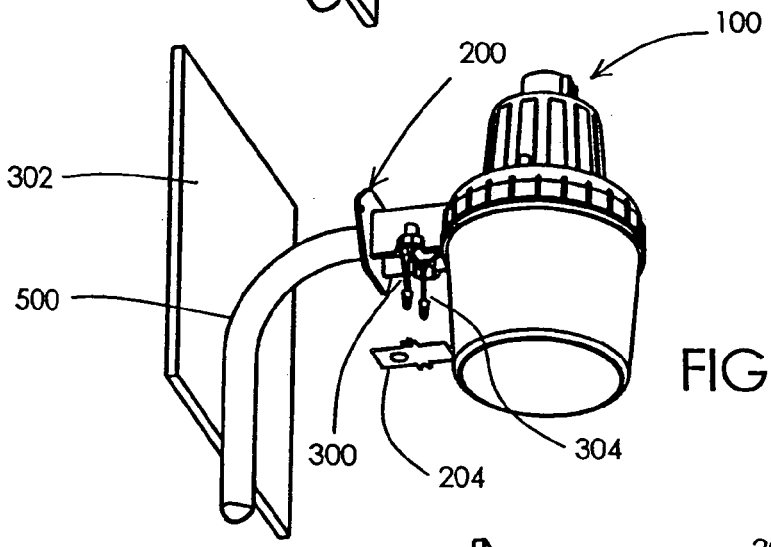
Figure 12C:
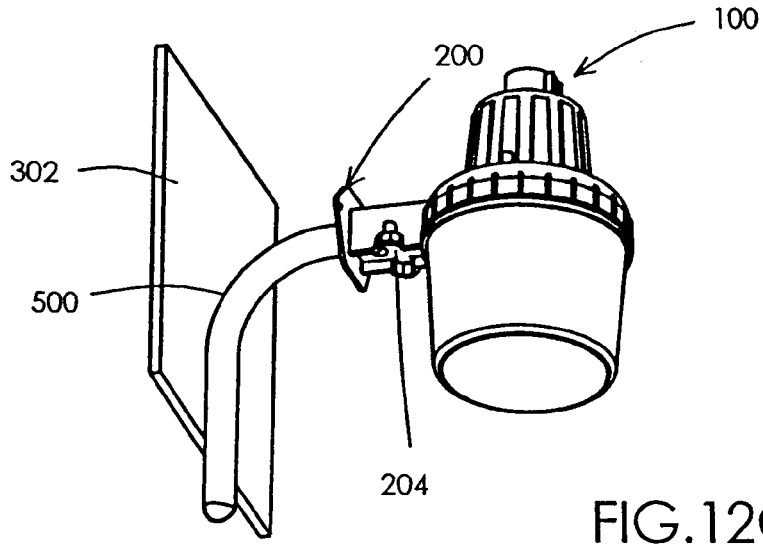

Third, if, as exemplified in FIGS. 12A–B, the electrician finds the power supply wires 300 protruding from a rigid metal pipe or conduit 500 that extends horizontally from a support structure 302, the following steps may be performed. The access plate 204 is removed. The frangible portion of the knock-out blank 208 is broken out by a hammer blow to the eye 210, thereby leaving an opening 212 in the plate 104. Any rough edges of the opening 212 may optionally be smoothed with a metal file preferably having a curved cross-section. The end portion of the horizontal conduit 500 is inserted through the opening 212, and pushed deep into the hollow suspension arm 106 so that the weight of the lighting system 100 is supported by the rigid conduit 500, thereby freeing the hands of the electrician to complete the remaining installation steps. The power supply wires 300 protruding from the conduit 500 are connected with the wires 304 extending from the housing of the lighting system 100. A clamping plate 254 is placed in position across the arm 106 and tightened over the conduit 254, optimally with the same screws 206 as used to hold the access plate 204 in position to enclose the hollow suspension arm 106. It is noted that the pipe used on commercial structures to provide power supply wiring to the exterior of a wall or support surface typically has an outside diameter of between about 1.25 inch to about 1.5 inch, so that the size of the frangible portion is preferably a circular opening of about 1.5 to 1.75 inch in diameter.

Figure 13:
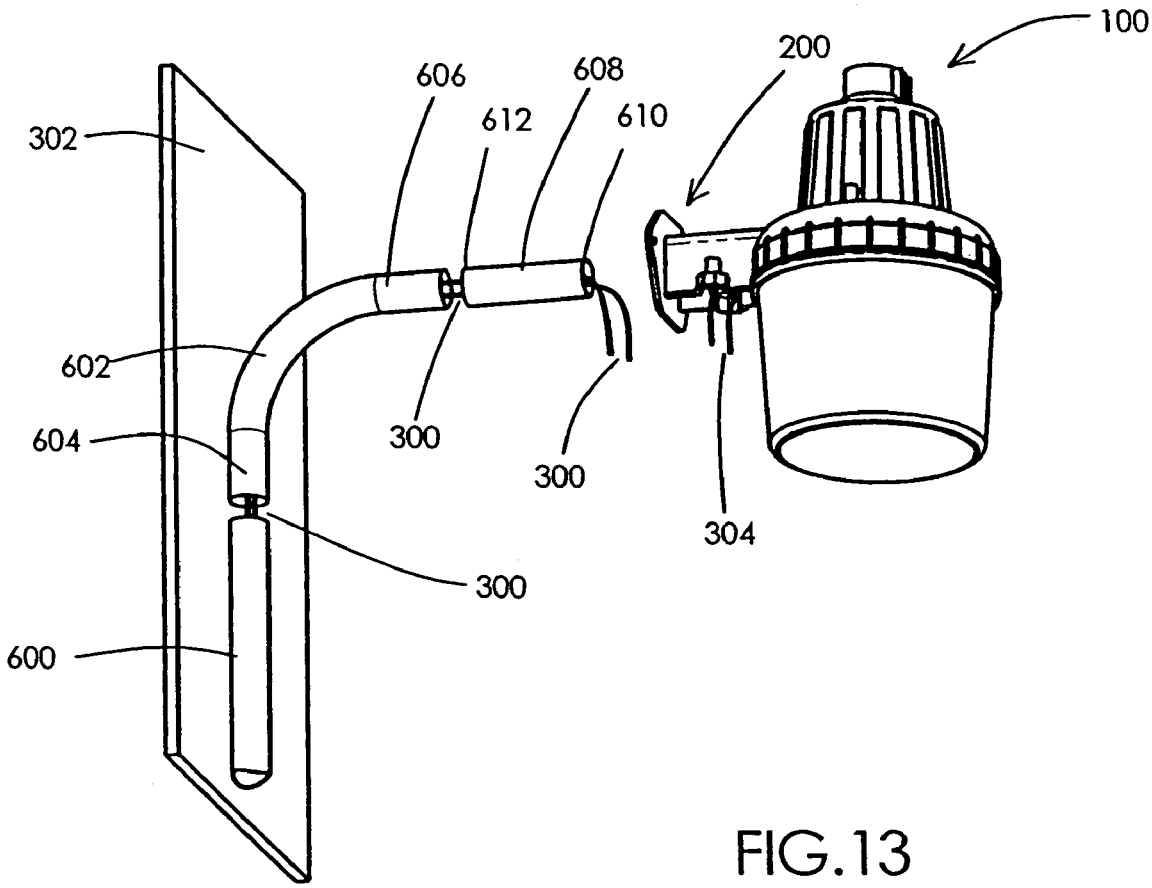
FIG. 13 shows use of straight and curved extension sections to mount the lighting system.

In a variation of the third method, exemplified in FIG. 13, the electrician may find a rigid pipe or conduit 600 carrying the power supply wires terminating vertically and not horizontally as expected. That is, the conduit 600 is a straight pipe with its opening facing straight up instead of facing horizontally and away from the support wall as in FIG. 12A. In such a case, the lighting system 100 may be optionally supplied in a kit of assembly pieces with a curved extension section 602 having a straight first section 604 suitable for insertion within or over the support structure conduit 600 to form a stable connection, and an optional second extension section 606 suitable for insertion into the back plate opening 212 to support the lighting system 100.

In yet a further embodiment, the kit may include a curved extension section 602 and another straight section 608. The curved extension section 602 is preferably a 90 degree bend, but other bends of 45 degrees, etc., are contemplated. As shown in FIG. 13, the straight extension section 608 may be used to extend the housing farther away from the support structure, or it could be used like straight extension section 604 to further elevate the housing. Therefore, any combination of the curved extension section 602 and the straight linear extension sections 604, 606, or 608 may be used or omitted to adjust and position the housing relative to the support structure. The kit gives the electrician even more customization and adaptability in the field to mount the lighting system 100.

Thus, it is apparent that the described embodiments of the present invention in their simplest forms have the advantage of being a unitary structure, with all the advantages this brings to packaging, shipping, and assembly. Yet at the same time, it is adaptable for attachment to a number of different structural or wiring configurations that may be found on a support structure in the field, while further allowing the electrician or technician to carry out installation on his or her own, without the assistance of a helper. Moreover, the lighting system may optionally be combined in a kit with curved and straight extension sections adapted to convert or modify, for example, a vertically terminating power supply conduit into a horizontally terminating power supply conduit, to move the housing farther away from the support structure, or to elevate the housing away from the ground.

While the specification describes particular embodiments of the present invention, it will also be apparent to those of ordinary skill that various modifications can be made without departing from the spirit and scope of the invention.

We claim:

1. A lighting system mounted to a support surface providing a power supply, comprising:
   - a housing containing a light source connected to the power supply;
   - a suspension arm extending from the housing, the suspension arm being hollow with an open back end and being closed at the bottom by a removable access plate; and
   - a back plate completely covering the open back end of the arm opposite the housing, the back plate being configured for connection to the support surface, wherein the back plate includes a liquid-impervious frangible portion configured to break out upon application of an impact blow so as to produce an opening therein.

2. The lighting system of claim 1, wherein the access plate includes a knock-out blank.

3. The lighting system of claim 1, wherein the frangible portion includes a pre-formed circular shape.

4. The lighting system of claim 1, wherein the frangible portion encloses a circular opening having a diameter in the range of between about 1.5 and 1.75 inch.

5. The lighting system of claim 1, wherein the arm includes at least one internal rib configured to engage a tubular conduit extending from the support surface.

6. The lighting system of claim 5, wherein the suspension arm includes a longitudinal axis and the at least one rib includes a plate with a flat portion arranged transverse to the longitudinal axis.

7. The lighting system of claim 1, wherein the hollow suspension arm receives a tubular conduit extending from the support surface therein and includes a bar clamp engaging the tubular conduit.

8. The lighting system of claim 1, wherein the frangible portion includes a thick wall at the center and a thin wall around the circumference.

9. The lighting system of claim 1, wherein the frangible portion includes a circumference having at least one of a notch, cut, and pre-score.

10. A method of installing a lighting system on a support surface with electric power supply wires, comprising:
   - providing a housing containing a light source, wherein the housing is joined to a hollow suspension arm with a back plate having a frangible portion and a removable access plate that includes a knock-out blank;
   - removing the access plate to open the hollow arm;
   - creating an opening in the back plate by breaking out the frangible portion;
   - inserting the rigid conduit through the opening in the back plate
   - inserting the power supply wires from the support surface through the opening;
   - attaching the back plate to the support surface;
   - connecting the power supply wires from the support surface to corresponding wires of the lighting system; and
   - reinstalling the access plate to seal the arm from the external environment.

11. The method of claim 10, wherein breaking out the frangible portion of the back plate includes exerting an impact blow to the frangible portion.

12. A method of installing a lighting system on a support surface having electrical wires contained in a flexible electrical conduit, comprising:
   - providing a housing that includes a hollow suspension arm with a back plate completely covering an open back end of the arm, wherein the suspension arm includes a removable access plate with a knock-out blank;

attaching the back plate to the support surface;

removing the access plate to open the hollow arm;

detaching the knock-out blank in the access plate to create an opening in the access plate;

inserting electric wires from an end of the flexible electrical conduit through the opening in the access plate;

connecting the electric wires from the flexible electrical conduit to the lighting system; and reinstalling the access plate on the arm.

13. The method of claim 12, wherein inserting electric wires from an end of a flexible electrical conduit includes attaching an end of the flexible electrical conduit to the opening in the access plate.

14. A method of installing a lighting system on a support surface having a rigid conduit containing electrical wires extending therefrom, comprising:

providing a housing with a hollow arm transitioning into a back plate, wherein the hollow arm includes a removable access plate, and the back plate includes a frangible portion;

removing the access plate to open the hollow arm;

breaking out a frangible portion of the back plate to create an opening therein;

inserting the rigid conduit through the opening in the back plate and into the hollow arm a sufficient depth such that the weight of the lighting system is supported only by the rigid conduit;

connecting the electrical wires from the rigid conduit to the lighting system;

providing a clamp plate and clamping the rigid conduit inside the arm; and reinstalling the access plate to the arm.

15. The method of claim 14, wherein clamping the rigid conduit and reinstalling the access plate are achieved by a single action.

16. The method of claim 15, wherein the single action includes screwing at least one screw into the arm to simultaneously secure the clamp plate and the access plate to the arm.

17. The method of claim 14, wherein the method further comprises providing a rigid extension conduit, attaching the rigid extension conduit to the rigid conduit of the support surface, and inserting the rigid extension conduit into the hollow arm.

18. The method of claim 17, wherein providing the rigid extension conduit includes providing at least one of a linear extension section and a curved extension section.

19. A kit for installing a lighting system to a support surface having a rigid conduit containing electrical supply wires, comprising:

a lighting system having a housing containing a light source;

a suspension arm extending from the housing, the arm being hollow and being closed by a removable bottom access plate;

a back plate disposed on the arm, wherein the back plate is configured for connection to the support surface and includes a frangible portion configured to break out upon application of an impact blow to produce an opening therein; and a rigid extension conduit connectable to the rigid conduit of the support surface at one end and insertable through the opening of the back plate and into the arm at an opposite end.

20. The kit of claim 19, wherein the rigid extension conduit includes at least one of a straight extension section and a curved extension section.

* * * * *